US006234368B1

(12) United States Patent
DesForges et al.

(10) Patent No.: US 6,234,368 B1
(45) Date of Patent: May 22, 2001

(54) PROTECTIVE BRA CAGE DEVICE FOR LAUNDERING DELICATE UNDERGARMENTS

(76) Inventors: Meryl J. DesForges, 2375 Old Ranch Rd., Escondido, CA (US) 92027; David O. Howells, 26 King Charles Avenue, Powick, Worcester (GB)

( * ) Notice: Subject to any disclaimer, the term of this patent is extended or adjusted under 35 U.S.C. 154(b) by 0 days.

(21) Appl. No.: 09/595,618

(22) Filed: Jun. 16, 2000

Related U.S. Application Data

(60) Provisional application No. 60/141,960, filed on Jul. 1, 1999.

(51) Int. Cl.[7] ..... D06C 15/00

(52) U.S. Cl. ..... 223/84; 223/66; 223/1

(58) Field of Search ..... 2032/84, 57, 66, 2032/1; 450/41–55

(56) References Cited

U.S. PATENT DOCUMENTS

| | | | |
|---|---|---|---|
| 2,190,807 | 2/1940 | Steinberger . | |
| 2,490,508 | 12/1949 | Delgatto . | |
| 2,755,004 | 7/1956 | Schumacher . | |
| 2,815,157 | 12/1957 | Badgley . | |
| 2,951,621 | 9/1960 | Cheney . | |
| 3,085,723 | 4/1963 | Vanderburg . | |
| 3,346,149 | 10/1967 | Tiss . | |
| 3,769,819 | 11/1973 | Contreras . | |
| 4,063,637 | 12/1977 | Danforth . | |
| 5,074,410 | 12/1991 | Fries et al. . | |
| 5,172,837 | 12/1992 | Finney, Jr. et al. . | |
| 5,211,191 | 5/1993 | Brown . | |
| 5,556,013 | 9/1996 | Mayer . | |
| 5,611,441 | 3/1997 | Bartko . | |
| 5,971,236 * | 10/1999 | DesForges et al. | 223/84 |

* cited by examiner

*Primary Examiner*—Bibhu Mohanty
(74) *Attorney, Agent, or Firm*—Loyal McKinley Hanson

(57) ABSTRACT

A device for protecting a brassiere and other delicate undergarments during laundering includes a pair of domed or hemispherically shaped shells adapted to assemble together over a cup of the brassiere as a protective covering for the cup. The outer shell has a circularly shaped first rim portion and a hemispherically shaped first dome portion larger than the cup of the brassiere that extends to the first rim portion. The inner shell has a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions. At least three pins are included on the second rim portion of the inner shell and at least three pin-engaging structures are provided on the outer shell for engaging the pins in order to removably secure the inner shell to the outer shell with the cup of the brassiere in between. Each pin-engaging structure preferably defines a slot adapted to receive a pin in multiple pin positions with a friction fit sufficient to engage the pin. A further improved embodiment includes a circularly shaped cover member adapted to fit on the inner cage in order to form an auxiliary compartment for at least one additional clothing article.

8 Claims, 4 Drawing Sheets

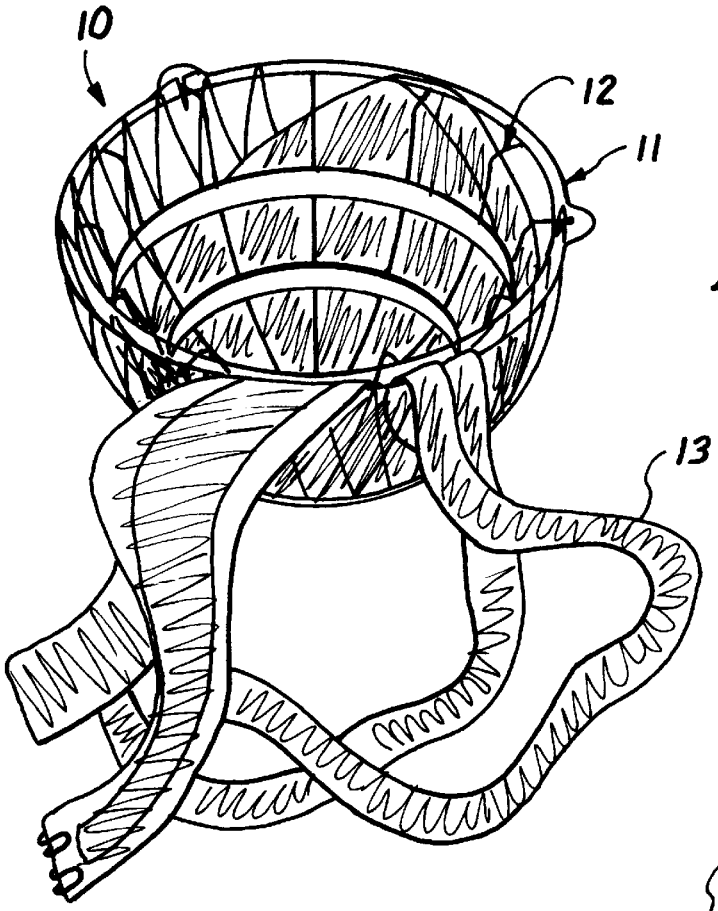
Fig. 1
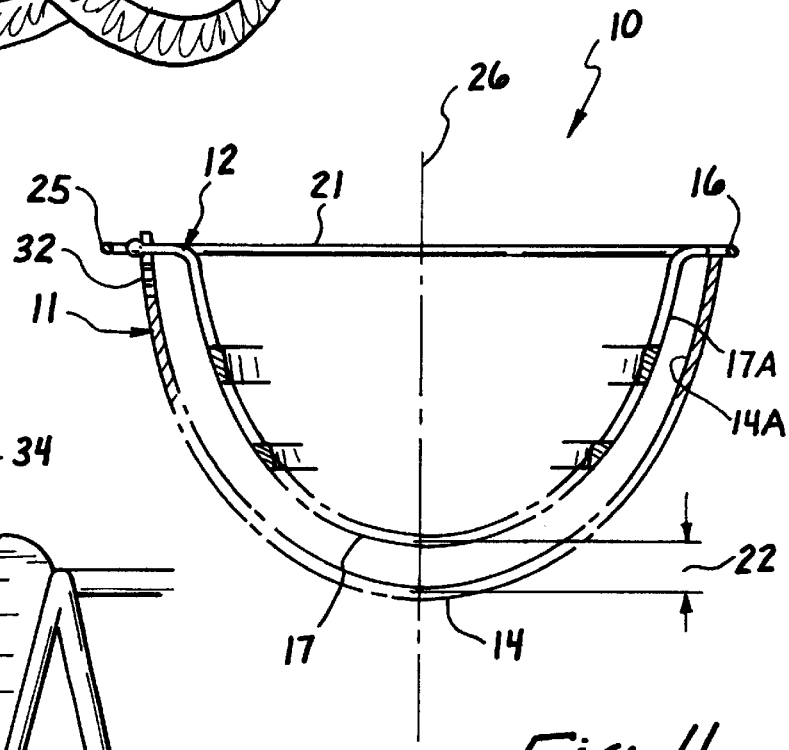
Fig. 4
Fig. 5
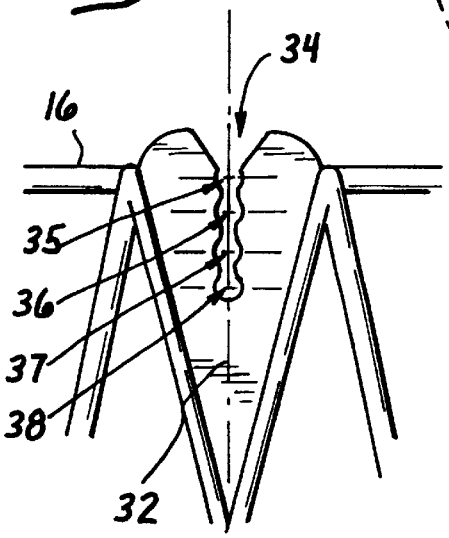

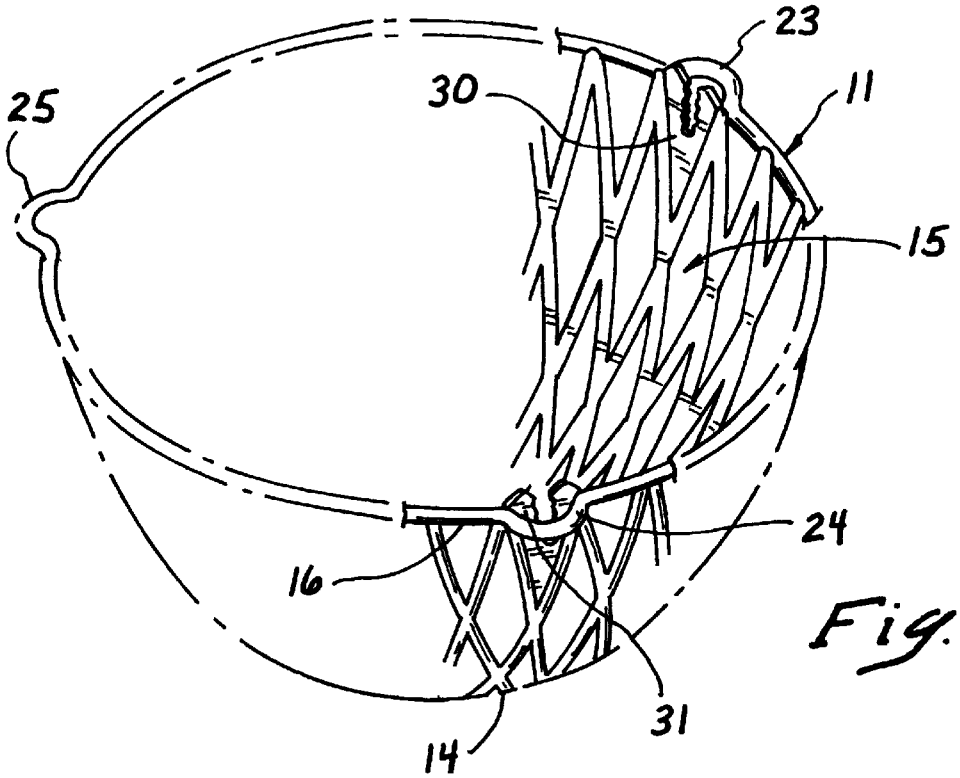
Fig. 2
Fig. 3
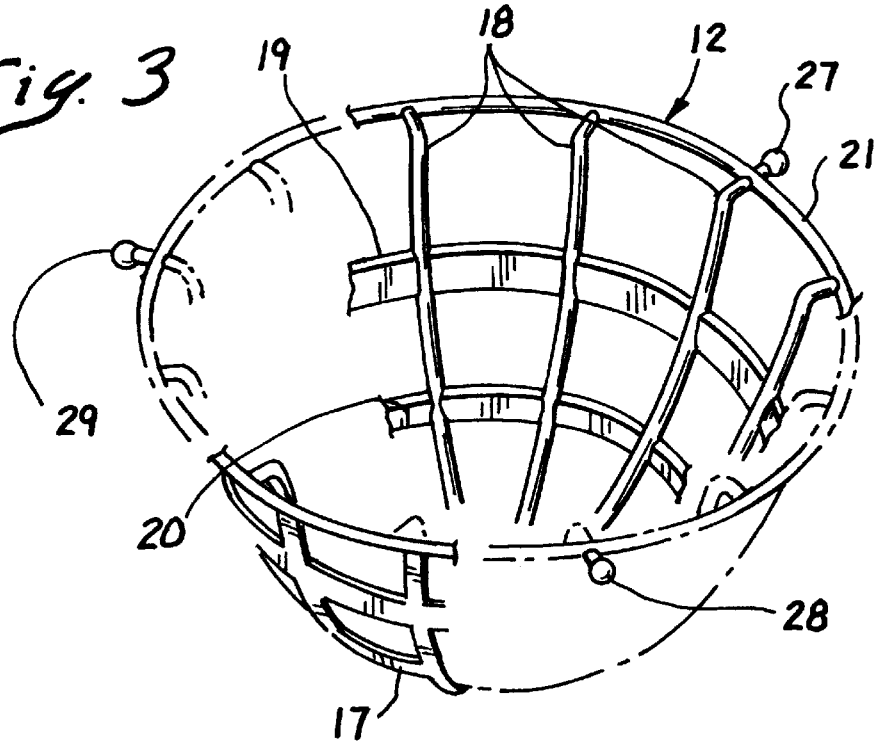

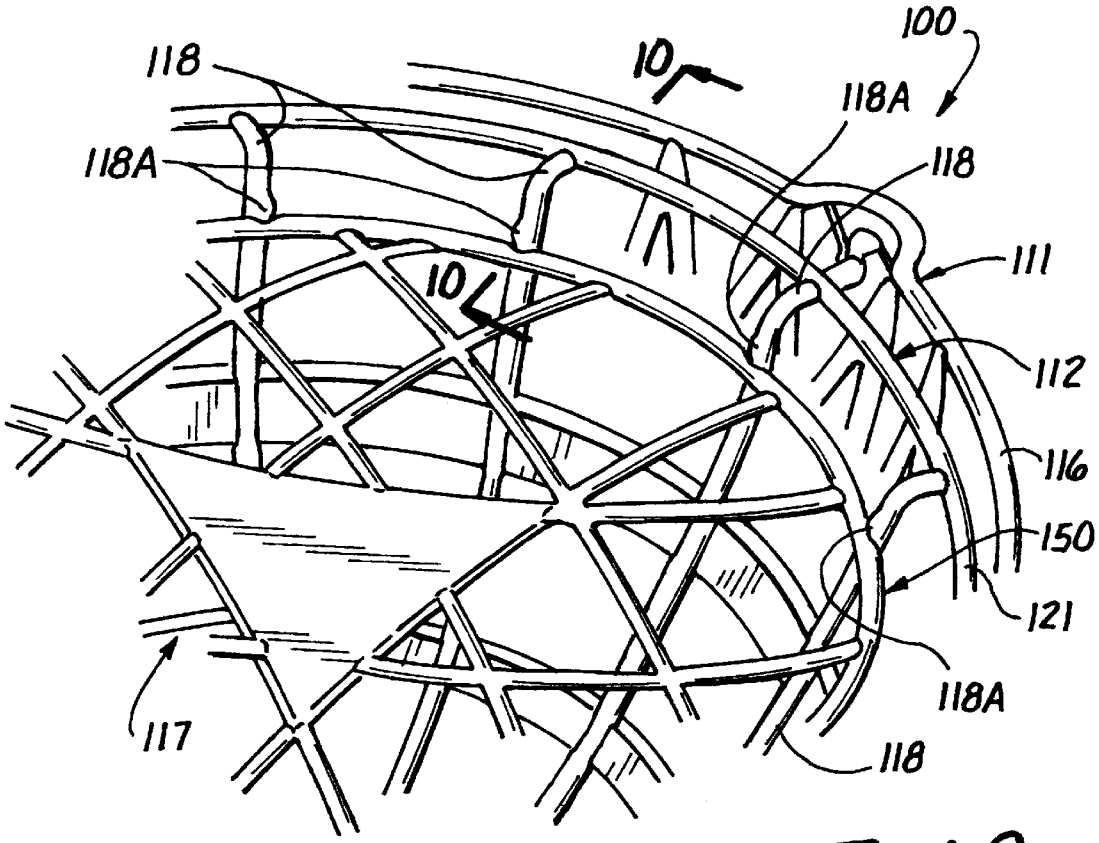
Fig. 8
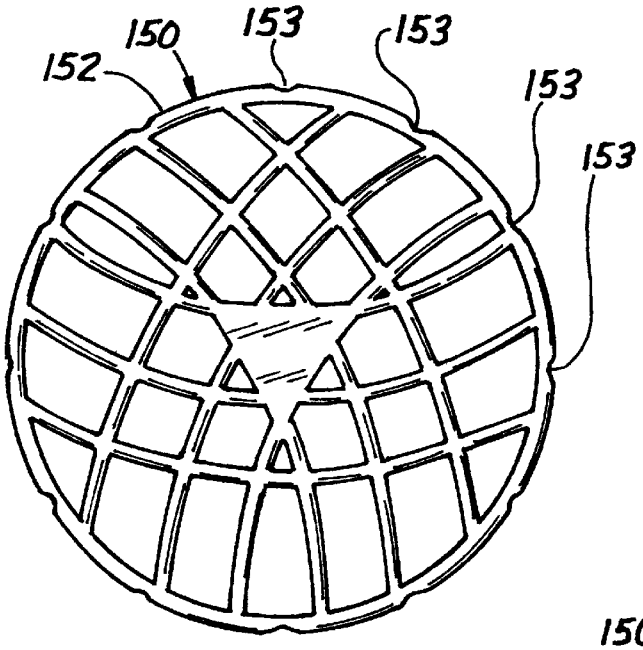
Fig. 9
Fig. 10
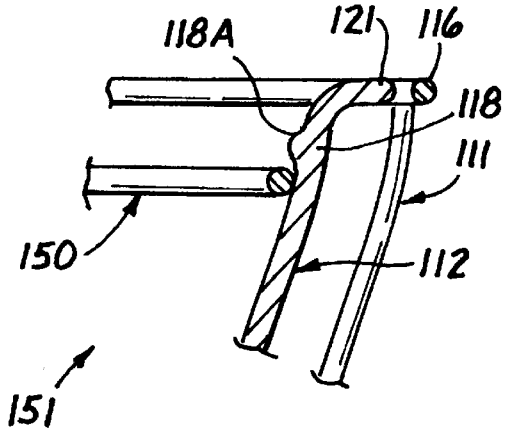

PROTECTIVE BRA CAGE DEVICE FOR LAUNDERING DELICATE UNDERGARMENTS

This application claims benefit of 60/141,960 filed Jul. 1, 1999.

BACKGROUND OF THE INVENTION

1. Technical Field

This invention relates generally to brassieres, and more particularly to a protective bra cage device for protecting a brassiere and other delicate undergarments during laundering in a washing machine.

2. Description of Related Art

Machine washing can easily damage a delicate brassiere. The garment protector of U.S. Pat. No. 5,556,013 alleviates that concern by using two domed-shaped basket members to hold the cups of the bra during laundering. After securing the cups tightly in the basket members with two hinged biasing members, the user rotates the basket members into a football-like configuration, locks them together, and proceeds to machine wash and dry the entire assembly.

Protecting the bra that way can help maintain the proper configuration of the cups without damage throughout the entire laundry cycle, but certain drawbacks exist. The hinged biasing members can put too much pressure on a delicate cup. They may not adequately adjust to and carefully hold various different bras, including sweater and pushup bras having different thicknesses of soft foam padding. The hinged biasing can introduce fabrication expense that might be avoided. Thus, consumers seek an improved device for protecting a bra during machine washing that is easier and less costly to fabricate while working better and lasting longer.

SUMMARY OF THE INVENTION

This invention addresses the problems outlined above by providing a protective bra cage device having separate inner and outer hemispherically shaped shells (i.e., rounded cups) that snap together in spaced-apart relationship with the bra cup held between them. They combined with a third member (a cover member) that fits onto the inner shell to form a compartment for panties or other delicate clothing articles. Pressure against the bra is more easily controlled. No failure-prone hinge holds the inner and outer shells together. They are easier and less costly to fabricate. One bra cage device can receive both cups of a bra or be used with a second device, and the cover member can be added whenever desired additional clothing articles with the bra.

To paraphrase some of the more precise language appearing in the claims, a protective bra cage device constructed according to the invention includes a pair of rounded cups or hemispherically shaped shells (preferably injection molded polypropylene material) adapted to assemble together over a cup of the brassiere as a protective covering for the cup. The outer shell has a circularly shaped first rim portion and a hemispherically shaped first dome portion larger than the cup of the brassiere that extends to the first rim portion. The inner shell has a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions.

At least three pins (i.e., posts or protrusions) are included on the second rim portion of the inner shell and at least three pin-engaging structures are provided on the outer shell for engaging the pins in order to removably secure the inner shell to the outer shell with the cup of the brassiere in between. Each pin-engaging structure preferably defines a slot adapted to receive a pin in a user selected one of multiple pin positions with a friction fit sufficient to engage the pin. So configured, the device is easier and less costly to fabricate while working better and lasting longer.

A preferred embodiment includes a circularly shaped third member (a cover member) that is adapted to fit on the inner shell in order to form an auxiliary compartment between the cover member and the inner shell for at least one additional clothing article. The cover member is adapted to fit removably within the rim portion of the inner member to form the compartment. The following illustrative drawings and detailed description make the foregoing and other objects, features, and advantages of the invention more apparent.

BRIEF DESCRIPTION OF THE DRAWINGS

FIG. 1 of the drawings is a perspective view of a protective bra cage device constructed according to the invention, with the inner and outer shells assembled over a brassiere;

FIG. 2 is an enlarged perspective view of just the outer shell, with portions of the repetitive diamond pattern omitted for illustrative convenience;

FIG. 3 is an enlarged perspective view of just the inner shell, with portions of the repetitive pattern of the rib and ring elements omitted for illustrative convenience;

FIG. 4 is a cross sectional view of the assembled inner and outer shells taken in a vertical plane with the brassiere omitted;

FIG. 5 is a further enlarged detail view of one of the three pin-engaging structures on the outer shell;

FIG. 8 is an enlarged view of a portion of a second embodiment of the invention that includes a cover member;

FIG. 9 is a reduced top view of the cover member; and

FIG. 10 is an enlarged portion showing a protrusion on a rib of the inner member that retains the cover member in place during laundering.

DESCRIPTION OF A PREFERRED EMBODIMENT

Figure 6:
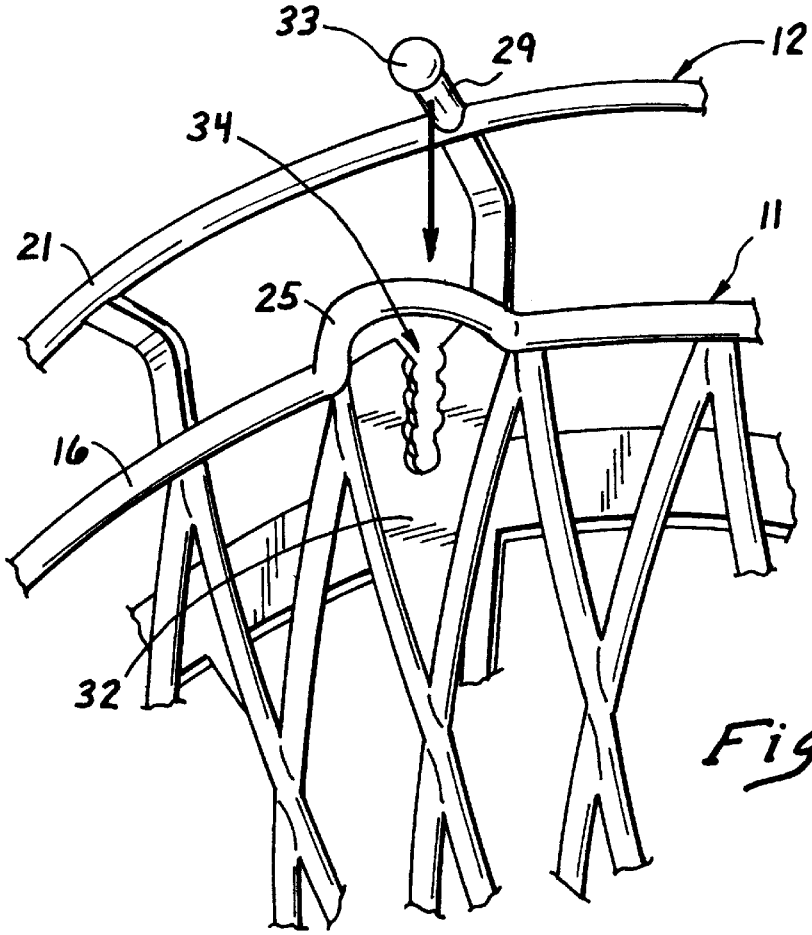
FIG. 6 is an enlarged view showing one of the three pins of the inner shell in position for placement into the corresponding pin-engaging structure on the outer shell.

FIGS. 1–7 show various aspects of a protective bra cage device 10 constructed according to the invention. Generally, the device 10 includes a pair of hemispherically shaped shells 11 and 12. They are referred to as an outer shell 11 (i.e., a first or outer cage member) and an inner shell 12 (i.e., a second or inner cage member), and they may be described more specifically as ellipsoid segments. Broadly speaking, however, they are domed or cup shaped so that they can be assembled together over a bra 13 (FIG. 1) for purposes of protecting the bra 13 during machine washing.

The bra 13 represents a conventional brassiere. It is a woman's close-fitting undergarment with two cups for bust support. The cups are stacked together (one cup cradling the other) before assembling the device 10 over them as suggested by FIG. 1. The cups of the bra 13 are then held between the outer and inner shells 11 and 12. Bra straps may also be held within the device 10, although they are left exposed in FIG. 1 for illustrative purposes. Of course, two separate protective bra cage devices may be used instead, one for each cup of the bra 13, without departing from the inventive concepts disclosed.

FIG. 2 is an enlarged view of just the outer shell 12. It is composed of a polypropylene material that is injection molded into the illustrated configuration. It includes a hemispherically shaped dome portion (a first dome portion 14) with structure that forms a pattern of diamond shaped openings (e.g., opening 15 in FIG. 2). This mesh helps protect fine, delicate fabrics and lace. The first dome portion 14 has a size larger than a cup of the bra 13 so that the cup can be placed within the first dome portion 14 as illustrated in FIG. 1. The first dome portion 14 extends to a circular first rim portion 16 of the outer shell 12. The first dome portion 14 defines an inwardly facing surface 14A (FIG. 4) that faces the outwardly facing portion of the bra cup (i.e., the portion of the bra cup that faces away from the body of a person wearing the bra).

FIG. 3 is an enlarged view of just the inner shell 13. It is also composed of a polypropylene material that is injection molded into the illustrated configuration. It includes a hemispherically shaped second dome portion 17 formed with rib dome elements 18 and ring dome elements 19 and 20 disposed as illustrated, just three of the rib dome elements 18 being designated in FIG. 3. The second dome portion 17 extends to a second rim portion 21 of the inner shell 13 and it has a size adapted to fit within the first dome portion 14 of the outer shell 11 with the first and second rim portions 16 and 21 in concentric relationship as depicted in FIG. 1. The fit is such that there is sufficient space between the first and second dome portions 14 and 17 (e.g., 0.5 inch) to accommodate the cup of the bra 13 between the dome portions. That space is designated with a reference numeral 22 in FIG. 4. The second dome portion 17 defines an outwardly facing surface 17A that faces the inwardly facing portion of the bra cup (i.e., the portion of the bra cup that faces toward the body of a person wearing the bra).

Figure 7:
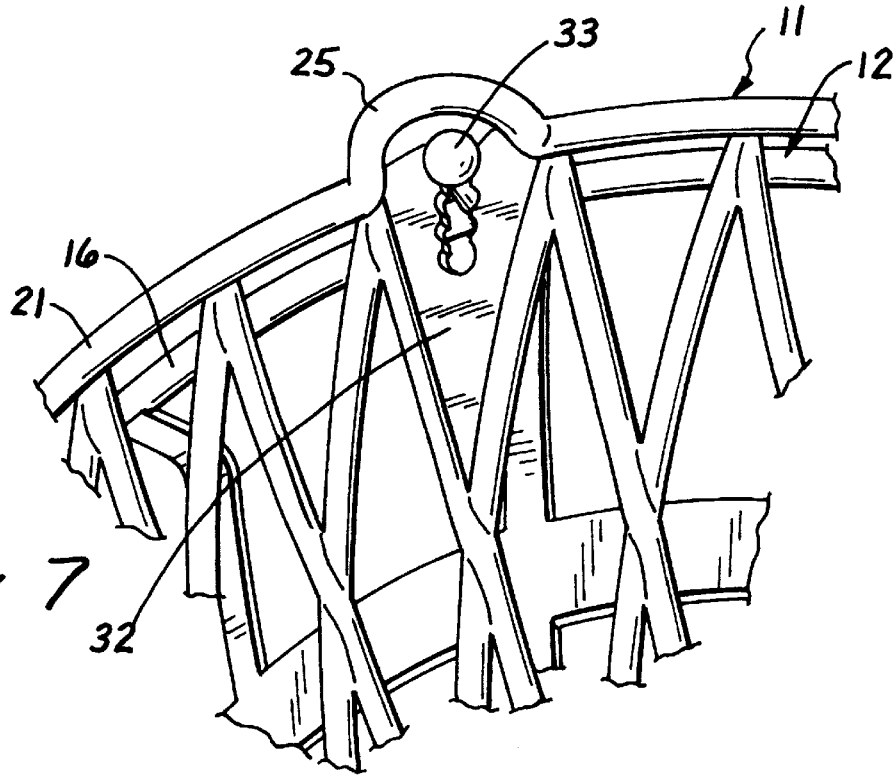
FIG. 7 is an enlarged view similar to FIG. 6 showing the pin held by the post-engaging structure in the first of four pin positions.

As a further idea of size, the first rim portion 16 of the outer shell is about 0.125 inch thick and it extends along a circular path along most of its length of about 6.0 inches in diameter, apart from the three bulges 23, 24, and 25 (FIG. 2) that provide space for locking mechanisms discussed further on in this description with reference to FIGS. 5, 6, and 7. The second rim portion 21 of the inner shell 12 is also about 0.125 inch thick and it extends along a circular path or about 5.625 inches in diameter. That dimensioning allows the second rim portion 21 to fit concentrically within the first rim portion 16 when the outer and inner shells 11 and 12 are assembled. When so assembled, the hemispherical shapes of the first and second dome portions 14 and 17 are symmetrically disposed about a central axis 26 in FIG. 4. Of course, other rounded hemispherical shapes may be employed without departing from the scope of the claims.

In order to hold the two shells 11 and 12 together, the inner shell 12 includes at least three pins 27, 28 and 29 (i.e., protrusions or posts) that protrude radially outwardly from the second rim portion 21 at uniform 120-degree intervals (FIG. 3), and the outer shell 11 includes at least three pin-engaging structures 30, 31, and 32 disposed at uniform 120-degree intervals adjacent the bulges 23, 24, and 25 in the first rim portion 16 (FIG. 2). Only the two pin-engaging structures 30 and 31 are illustrated in FIG. 2, but the pin-engaging structure 32 is shown in FIG. 4. When the user assembles the inner and outer shells 11 and 12 into the configuration shown in FIG. 4, the three pin-engaging structures 28 removably engage the three pins 27 and that holds the two shells together.

The three pins 27, 28, and 29 are similar and so only the pin 29 is described in further detail. Preferably, it is injection molded as an integral part of the inner shell 12 in one-piece construction. It measures about 0.125 inch in diameter, extends radially outwardly about 0.6 inch from the second rim portion 21, and includes a 3/16-inch diameter spherically shaped enlargement or knob 33 at the outermost end.

The three pin-engaging structures 30, 31, and 32 are also similar and so only the pin-engaging structure 32 is described in further detail. It is injection molded as an integral part of the outer shell 11 in one-piece construction. It defines a slot 34 (FIG. 5) that is 0.090 inch in width at its narrower regions and about 0.120 inch wide at each of four circular reliefs 35, 36, 37, and 38 that are spaced apart on 0.125-inch centers.

To assemble the shells 11 and 12, the user moves the pin 29 toward the slot 34 as depicted in FIG. 6. Then, as the user forces the pin 29 into the slot 34, the pin-engaging structure 32 resiliently deforms slightly to receive and engage the pin 29 in a force fit while the knob 33 keeps the pin from sliding out of the slot 34 (radially relative to the circular first rim portion 16). The four reliefs 35–38 designated in FIG. 5 define four pin positions. The user pushes the pin 29 to the desired one of those four pin positions in order to adjust the spacing between the shells 11 and 12 designated by the reference numeral 22 in FIG. 4. That feature enables the user to adjust the pressure the inner shell 12 applies to the bra 13 when the bra 13 is held between the two shells 11 and 12. FIG. 7 shows the pin 29 in the first pin position defined by the relief 35. The user simply pulls the two shells 11 and 12 apart to disassemble them.

FIGS. 8–10 illustrate various details of a preferred second embodiment of the invention, a protective bra cage device 100. The device 100 is similar in many respects to the device 10 and so only differences are described in further detail. For convenience, reference numerals designating parts of the device 100 are increased by one hundred over those designating parts of the device 10.

The device 100 includes outer and inner shells 111 and 112 that fit together in a manner similar to that of the shells 11 and 12 to protect a bra (not shown) during laundering. The major difference is that the shells 111 and 112 combine with a third member, a cover member 150, to form an auxiliary compartment 151 between the cover member 150 and the inner shell 112. The auxiliary compartment is designated in FIG. 10.

The outer and inner shells 111 and 112 are similar in construction to the outer and inner shells 11 and 12 in most respects, with the major difference being that the rib dome elements 118 include small protrusions 118A that protrude inwardly. So configured, the small protrusions 118A help retain the cover member 150 in place over the auxiliary compartment 151. Only four rib dome elements 118 and the four corresponding protrusions 118A are visible in FIG. 8. One rib dome element 118 and the corresponding protrusion 118A is also shown in FIG. 10.

The cover member 150 is illustrated by itself in FIG. 9. It is a disc shaped or circularly shaped component formed from an injection molded polypropylene material to include an outer rim 152 with uniformly spaced apart indentations or scallops 153. Only four scallops 153 are designated in FIG. 9 for illustrative convenience in order to keep FIG. 9 uncluttered. A total of twelve scallops 153 appear for the illustrated cover member 150, however, one for each of the twelve rib dome elements 118 of the inner shell 112. Of course, a greater or lesser number may be provided without departing from the inventive concepts disclosed.

The outer rim 152 of the cover member 150 has an outside diameter such that the scallops 153 in the outer rim 152 fit snugly against the rib dome elements 118 just beneath the protrusions 118A in the positions shown in FIGS. 8 and 10. After placing panties or other delicate clothing articles in the dome portion of the inner shell 112, the user places the cover member 150 in the illustrated position where it is retained by the rib dome elements 118 and the protrusions 118A. After laundering, the user snaps the cover member 150 out of position to remove the laundered articles.

Thus, the invention provides protective bra cage devices having separate inner and outer domed or hemispherically shaped shells that snap together in spaced-apart relationship with the bra cup held between them. Pressure against the bra is more easily controlled. No failure-prone hinge holds them together. The device is easier and less costly to fabricate. One bra cage device can receive both cups of a bra or be used with a second device. And the further improved second embodiment includes covered auxiliary compartment for simultaneous laundering of panties or other delicate clothing articles.

Although exemplary embodiments have been shown and described, one of ordinary skill in the art may make many changes, modifications, and substitutions without necessarily departing from the spirit and scope of the invention. The term "hemispherically shaped" and derivatives thereof, for example, are intended to mean a rounded shape suitable for holding the cup of a bra and such a shape can be somewhat different than an exact one-half portion of a perfect sphere. Thus, it is intended that the meaning of the term "hemispherically shaped" be such as to include elliptically shaped, parabolically shaped, and any other dome-shaped and/or cup-shaped configurations. It is intended that the claims be broadly interpreted in that regard so that any of such variously shaped shells and domed portions fall within the scope of the claims.

What is claimed is:

1. A device for protecting a brassiere in a washing machine, comprising:

a pair of hemispherically shaped shells adapted to assemble together over a cup of the brassiere as a protective covering for the cup;

an outer shell of the pair of hemispherically shaped shells, the outer shell having a circularly shaped first rim portion and a hemispherically shaped first dome portion that extends to the first rim portion, said first dome portion having a size larger than the cup of the brassiere;

an inner shell of the pair of hemispherically shaped shells, the inner shell having a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions;

at least three pins on the inner shell that protrude radially outwardly from the second rim portion at circumferentially spaced apart locations;

means on the outer shell for engaging the pins in order to removably secure the inner shell to the outer shell with the cup of the brassiere in between, said means including at least three pin-engaging structures on the outer shell at circumferentially spaced apart locations along the first rim portion that are each adapted to removably engage one of the pins when a user assembles the inner and outer shells over the cup; and a cover member adapted to fit on the inner shell in order to form an auxiliary compartment between the cover member and the inner shell for at least one additional clothing article.

2. A device as recited in claim 1, wherein at least one of the first and second shells is composed of an injection molded polypropylene material.

3. A device as recited in claim 1, wherein at least one of the pin-engaging structures defines a slot adapted to receive a pin with a friction fit sufficient to engage the pin.

4. A device as recited in claim 1, wherein at least one of the pin-engaging structures defines a slot adapted to receive a pin with a friction fit sufficient to engage the pin, and the slot includes multiple reliefs that define multiple pin positions the user can select from in order to selectively vary pressure of the inner shell against the cup of the brassiere.

5. A device as recited in claim 1, wherein the first dome portion of the outer shell includes elements arranged in a diamond mesh pattern.

6. A device as recited in claim 1, wherein the second dome portion of the inner shell includes a pattern of ring elements supported by rib elements.

7. A device for protecting a brassiere, comprising:

a pair of hemispherically shaped shells that are composed of an injection molded polypropylene material and adapted to assemble together over a cup of the brassiere as a protective covering for the cup;

an outer shell of the pair of hemispherically shaped shells, the outer shell having a circularly shaped first rim portion and a hemispherically shaped first dome portion that extends to the first rim portion, said first dome portion having a size larger than the cup of the brassiere;

an inner shell of the pair of hemispherically shaped shells, the inner shell having a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions;

three pins on the inner shell that extend radially outwardly from the second rim portion at circumferentially spaced apart locations;

means on the outer shell for engaging the pins in order to removably secure the inner shell to the outer shell with the cup of the brassiere in between, said means including three pin-engaging structures on the outer shell at circumferentially spaced apart locations along the first rim portion that are each adapted to removably engage one of the three pins when a user assembles the inner and outer shells over the cup, each of the pin-engaging structures defining a slot adapted to receive a post in a user selected one of multiple pin positions with a friction fit sufficient to engage the post; and a cover member adapted to fit on the inner shell in order to form an auxiliary compartment between the cover member and the inner shell for at least one additional clothing article.

8. A device for laundering delicate undergarments, comprising:

a single outer shell and a single inner shell that are adapted to fit together over a brassiere as a single protective cage for the brassiere, the outer shell having a circularly shaped first rim portion and a hemispherically shaped first dome portion that extends to the first rim portion, said first dome portion having a size larger than the cup of the brassiere, and the inner shell having a circularly shaped second rim portion and a hemispherically shaped second dome portion that extends to the second rim portion, said second dome portion having a size adapted to fit within the first dome portion of the outer shell with the first and second rim portions in concentric relationship and the cup of the brassiere disposed intermediate the first and second dome portions; and a disc shaped cover member adapted to fit on the inner shell in order to form an auxiliary compartment between the cover member and the inner shell for at least one additional clothing article.

* * * * *